US008622038B2

(12) United States Patent
Strauss

(10) Patent No.: US 8,622,038 B2
(45) Date of Patent: Jan. 7, 2014

(54) DEVICE FOR VARIABLY ADJUSTING THE CONTROL TIMES OF GAS EXCHANGE VALVES OF AN INTERNAL COMBUSTION ENGINE

(75) Inventor: Andreas Strauss, Forchheim (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 275 days.

(21) Appl. No.: 13/123,125

(22) PCT Filed: Sep. 9, 2009

(86) PCT No.: PCT/EP2009/061674

§ 371 (c)(1),
(2), (4) Date: Apr. 7, 2011

(87) PCT Pub. No.: WO2010/040617

PCT Pub. Date: Apr. 15, 2010

(65) Prior Publication Data

US 2011/0239966 A1 Oct. 6, 2011

(30) Foreign Application Priority Data

Oct. 7, 2008 (DE) ..... 10 2008 050 672

(51) Int. Cl.
*F01L 1/34* (2006.01)

(52) U.S. Cl.
USPC ..... 123/90.17; 138/31

(58) Field of Classification Search
USPC ..... 123/90.17, 90.15, 90.16, 90.31, 90.12, 123/90.33–90.38, 90.6; 138/31
See application file for complete search history.

(56) References Cited

U.S. PATENT DOCUMENTS

| | | | | |
|---|---|---|---|---|
| 2,688,984 | A * | 9/1954 | Snyder | 138/31 |
| 6,782,856 | B2 * | 8/2004 | Aimone | 123/90.34 |
| 6,871,620 | B2 | 3/2005 | Aimone | |
| 7,108,016 | B2 * | 9/2006 | Moskalik et al. | 138/31 |
| 2003/0188705 | A1 | 10/2003 | Aimone | |
| 2006/0060159 | A1 | 3/2006 | Moretz et al. | |

FOREIGN PATENT DOCUMENTS

| | | | |
|---|---|---|---|
| DE | 195 29 277 | A1 | 2/1997 |
| DE | 102 28 354 | A1 | 1/2004 |
| DE | 10228354 | A1 * | 1/2004 |
| DE | 10 2007 041552 | A1 | 3/2009 |
| JP | 11 153014 | A | 6/1999 |

* cited by examiner

*Primary Examiner* — Kenneth Bomberg
*Assistant Examiner* — Wesley Harris
(74) *Attorney, Agent, or Firm* — Lucas & Mercanti, LLP

(57) ABSTRACT

The invention relates to a device (11) for variably adjusting the control times of gas exchange valves (9, 10) of an internal combustion engine (1) having a hydraulic phase shifting device (12), a camshaft (6, 7), and a pressure accumulator (15), wherein the phase shifting device (12) can be brought into a drive connection with a crankshaft (2) and is connected to the camshaft (6, 7) in a rotationally fixed manner, wherein a phase position of the camshaft (6, 7) relative to the crankshaft (2) can be variably adjusted by means of the phase shifting device (12) and wherein the interior of the camshaft (6, 7) comprises a cavity (38).

8 Claims, 4 Drawing Sheets

DEVICE FOR VARIABLY ADJUSTING THE CONTROL TIMES OF GAS EXCHANGE VALVES OF AN INTERNAL COMBUSTION ENGINE

This application is a 371 of PCT/EP2009/061674 filed Sep. 9, 2009, which in turn claims the priority of DE 10 2008 050 672.9 filed Oct. 7, 2008, the priority of both applications is hereby claimed and both applications are incorporated by reference herein.

FIELD OF THE INVENTION

The invention relates to a device for variably adjusting the control times of gas exchange valves of an internal combustion engine having a hydraulic phase setting device, a camshaft and a pressure accumulator, it being possible for the phase setting device to be brought into a drive connection with a crankshaft, and said phase setting device being connected fixedly to the camshaft so as to rotate with it, a phase relation of the camshaft relative to the crankshaft being variably adjustable by means of the phase setting device, and the interior of the camshaft having a cavity.

BACKGROUND OF THE INVENTION

In modern internal combustion engines, devices are used for variably adjusting the control times of gas exchange valves, in order for it to be possible to variably configure the phase relation between the crankshaft and the camshaft in a defined angular range, between a maximum early position and a maximum late position. The device usually comprises a camshaft and a hydraulic phase setting device, by means of which a phase relation between the crankshaft and the camshaft can be changed in a targeted manner by way of feeding in or discharging pressure medium. For this purpose, the phase setting device is integrated into a drive train, via which torque is transmitted from the crankshaft to the camshaft. Said drive train can be realized, for example, as a belt drive, chain drive or a gearwheel drive.

A device of this type is known, for example, from DE 195 29 277 A1. The device comprises a phase setting device and a camshaft. The phase setting device has an output element which is arranged such that it can be rotated with respect to a drive element. The drive element is drive connected to the crankshaft. The output element and the drive element delimit a pressure space which is divided by means of an axially displaceable piston into two pressure chambers which act counter to one another. The piston is displaced within the pressure space by feeding in or discharging pressure medium from the pressure chambers. The piston has a helical toothing system which meshes with a helical toothing system of the camshaft. A targeted rotation of the camshaft with respect to the crankshaft can therefore be brought about by the axial displacement of the piston.

Furthermore, the device has a pressure accumulator which is arranged in a crankcase or a cylinder head of the internal combustion engine. During the normal operation of the internal combustion engine, the pressure accumulator is filled with pressure medium, as a rule the engine oil, by a pressure medium pump. If the system pressure which is delivered by the pressure medium pump falls below a value which is required for the functionally reliable operation of the device, the pressure accumulator is emptied into the pressure medium circuit of the internal combustion engine. Brief minimum pressure undershoots within the pressure medium system can therefore be absorbed and/or the volumetric flow can be increased.

A disadvantage of this embodiment is the great space requirement of the pressure accumulator within the crankcase or the cylinder head.

SUMMARY OF THE INVENTION

The invention is based on the object of providing a device for variably adjusting the control times of gas exchange valves of an internal combustion engine, it being intended that the installation space requirement of the device is reduced.

According to the invention, the object is achieved by virtue of the fact that the pressure accumulator is arranged in the cavity and communicates with the phase setting device.

The device has at least one hydraulic phase setting device, one camshaft and one pressure accumulator. The phase setting device comprises at least one drive element and one output element. In the mounted state of the device, the drive element is drive connected to the crankshaft via a flexible drive, for example a belt or chain drive or a gearwheel drive. The output element is arranged such that it can be pivoted relative to the drive element in an angular range and is fastened fixedly to the camshaft so as to rotate with it.

At least one pressure chamber is provided within the device, by the pressure loading of which at least one pressure chamber the output element can be pivoted relative to the drive element and therefore the camshaft can be pivoted relative to the crankshaft. One or a plurality of pairs of pressure chambers which act counter to one another is/are advantageously provided.

The camshaft has a cavity. Said camshaft can be configured, for example, as a hollow shaft. Embodiments are likewise conceivable, in which the camshaft is configured as a tube, on the outer circumferential face of which cams are fastened in a nonpositive manner, a positive manner or with a material to material fit. However, camshafts of solid configuration are likewise also conceivable, in which a cavity is provided, for example in the form of a blind bore. The pressure accumulator is arranged in the cavity of the camshaft. The pressure accumulator can be connected in a stationary manner to the camshaft, for example in a positive manner, a nonpositive manner or with a material to material fit.

Pressure medium can be fed to the interior of the camshaft, for example via a camshaft bearing. The pressure medium passes firstly to the hydraulic phase setting device; and secondly to the pressure accumulator which is filled with pressure medium during the normal operation of the internal combustion engine. At the beginning of a phase adjustment, a defined quantity of pressure medium is removed from the pressure medium system of the internal combustion engine. As a consequence of this, the system pressure drops to a lower level. The system pressure which is present before the adjustment is not available in its full extent for the phase adjustment. The adjusting speed of the phase adjustment and therefore the performance of the entire internal combustion engine drop. If the pressure accumulator is filled, this pressure drop is absorbed by it, and the adjusting speed is held at a high level. The installation space requirement of the internal combustion engine is significantly reduced by the arrangement of the pressure accumulator within the camshaft, an installation space which is otherwise unused.

In one implementation of the invention, it is proposed that the pressure accumulator has a longitudinally displaceable piston. Furthermore, the pressure accumulator can have a spring element which loads the piston with a force counter to the force of the pressure medium. As an alternative, for example, gas cushions can be provided as force accumulators. The pressure accumulator can be configured, for example, as a piston accumulator, in particular as a piston spring accumulator. This represents a very robust solution.

There is provision in one development of the invention for the pressure accumulator to have a housing which is arranged in the cavity and in which the piston is guided such that it can be displaced longitudinally. A wall of the cavity of the camshaft therefore does not have to be machined further in a complicated manner. The running face of the piston is provided by an inner circumferential face of the housing. The housing can be realized, for example, as a cylindrical or pot-shaped sheet metal part which can be manufactured, for example, by a chipless shaping process, for example by a deep drawing method. As a result, the weight and the manufacturing costs of the housing are kept low. As a result of the deep drawing method, the running face of the piston is automatically manufactured with the necessary accuracy. Complicated further machining steps are not necessary.

Furthermore, there can be provision for the pressure accumulator to be arranged in a stationary manner in the cavity between the housing and a wall of said cavity by means of a nonpositive connection. As an alternative, material to material or positive connections can also be provided, such as adhesive, soldered or welded connections.

There can be provision in one implementation for the housing to have a guide section and for the piston to have an outer circumferential face which is adapted to an inner circumferential face of the guide section. The piston is guided in an axially movable manner on a guide face of the guide section. Here, the length of the guide section corresponds to the stroke of the piston within the pressure accumulator. The guide section can extend, for example, over the entire length of the piston. There can be provision in this embodiment for the nonpositive connection between the housing and the wall of the cavity to be configured along the entire length of the guide section, as a result of which the connection is given a high stability. For this purpose, its outer circumferential face is to be adapted to the wall of the cavity. As an alternative, there can be provision, at both axial ends of the guide section, for the housing to have a region of increased diameter, the outer circumferential faces of which are adapted to the wall of the cavity. There is therefore a nonpositive connection only between the regions of increased diameter and the wall of the cavity. As a result, a deformation of the guide face is avoided during the mounting of the pressure accumulator in the cavity, which could lead to jamming of the piston in the housing.

Furthermore, there can be provision for the housing to have at least one stop for limiting the travel of the piston at least in one displacement direction of the piston, advantageously in both. Furthermore, there can be provision for the camshaft to be of tubular configuration.

BRIEF DESCRIPTION OF THE DRAWINGS

Further features of the invention result from the following description and from the drawings, in which exemplary embodiments of the invention are shown in simplified form. In the drawings.

DETAILED DESCRIPTION OF THE DRAWINGS

Figure 1:
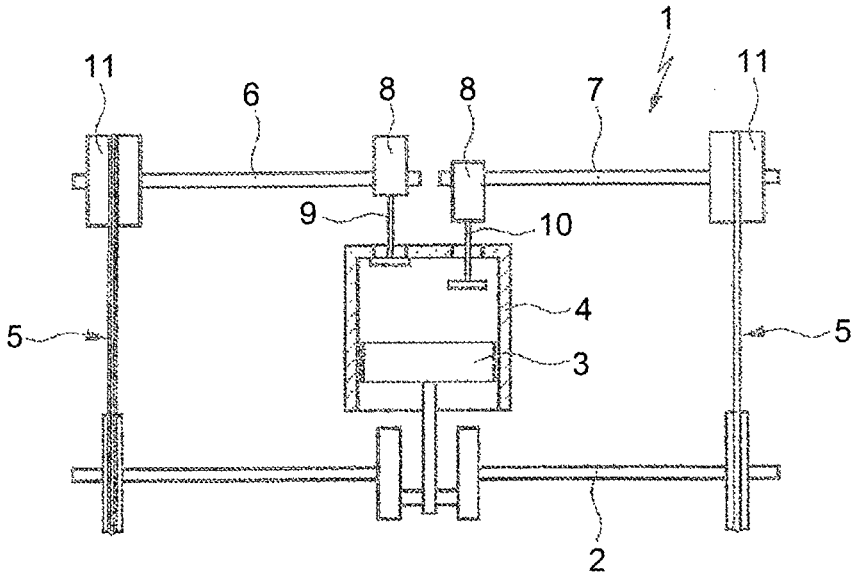
FIG. 1 shows an internal combustion engine in an only very diagrammatic way.

FIG. 1 outlines an internal combustion engine 1, a piston 3 which is seated on a crankshaft 2 in a cylinder 4 being indicated. In the embodiment which is shown, the crankshaft 2 is connected via in each case one flexible drive 5 to an inlet camshaft 6 and outlet camshaft 7, it being possible for a first and a second device 11 to ensure a relative rotation between the crankshaft 2 and the camshafts 6, 7. Cams 8 of the camshafts 6, 7 actuate one or more inlet gas exchange valves 9 and one or more outlet gas exchange valves 10. There can likewise be provision for only one of the camshafts 6, 7 to be equipped with a device 11, or for only one camshaft 6, 7 to be provided which is provided with a device 11.

Figure 3:
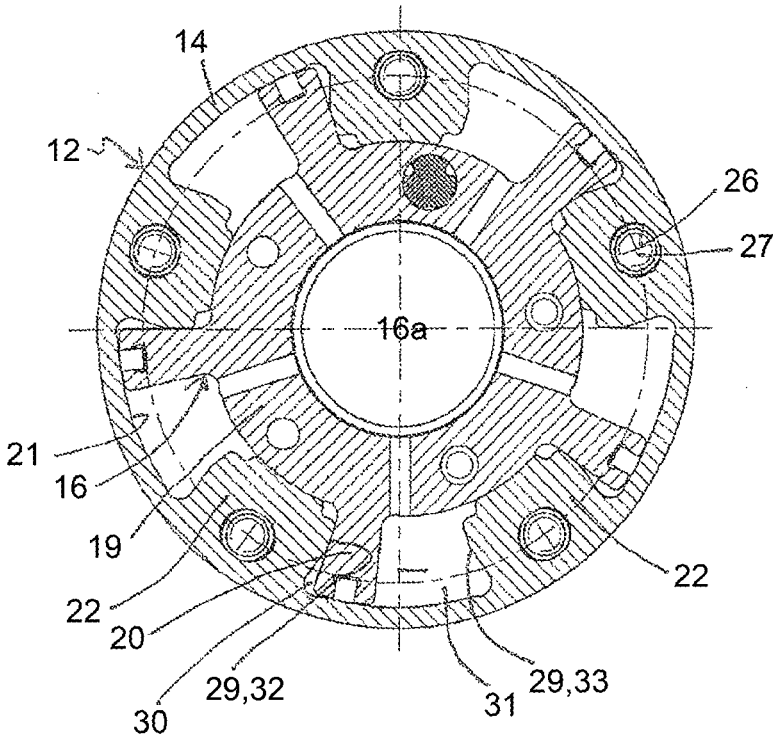
FIG. 3 shows a cross section through the phase setting device from FIG. 2 along the line III-III, the central screw not being shown.
Figure 2:
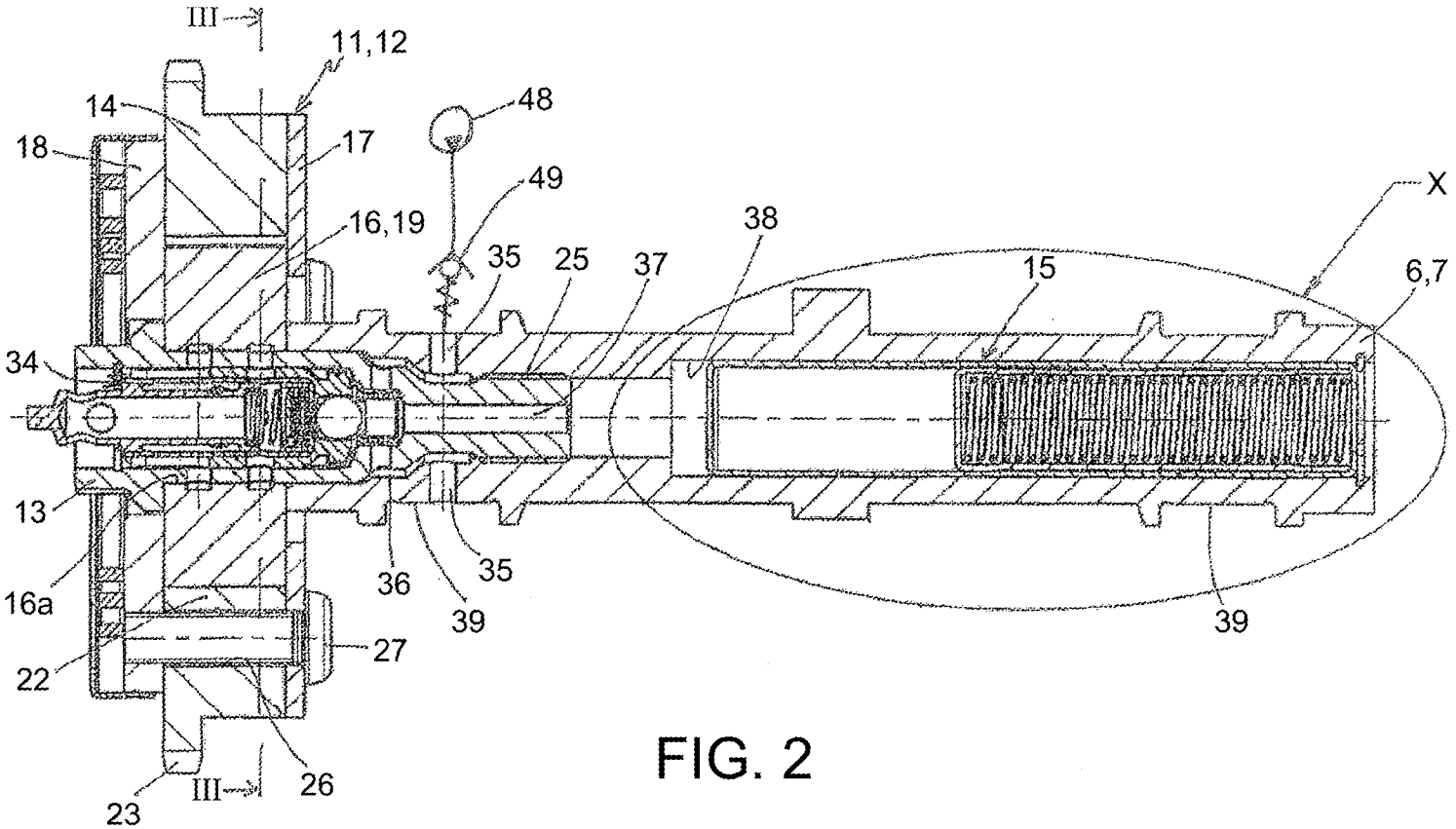
FIG. 2 shows a longitudinal section through a first embodiment according to the invention of a device for changing the control times of gas exchange valves of an internal combustion engine.

FIGS. 2 and 3 show a first embodiment of a device 11 according to the invention in longitudinal and transverse cross section. The device 11 has a phase setting device 12, a camshaft 6, 7 and a pressure accumulator 15.

The phase setting device 12 comprises a drive element 14, an output element 16 and two side covers 17, 18 which are arranged on the axial side faces of the drive element 14. The output element 16 is configured in the form of an impeller wheel and has a substantially cylindrically configured hub element 19, from the outer cylindrical circumferential face of which five vanes 20 extend in the radial direction to the outside in the embodiment which is shown.

Starting from an outer circumferential wall 21 of the drive element 14, five projections 22 extend radially to the inside. In the embodiment which is shown, the projections 22 and the vanes 20 are configured integrally with the circumferential wall 21 and the hub element 19, respectively. The drive element 14 is arranged such that it can be rotated with respect to the output element 16 by means of radially inner circumferential walls of the projections 22 relative to said output element 16.

A chain sprocket 23 is formed on an outer circumferential face of the drive element 14, via which chain sprocket 23 torque can be transmitted from the crankshaft 2 to the drive element 14 by means of a chain drive (not shown). The output element 16 is connected fixedly to the camshaft 6, 7 so as to rotate with it. For this purpose, in the embodiment which is shown, a central screw 13 reaches through a central opening **16*a* of the output element 16 and engages into a threaded section 25 of the camshaft 6, 7. Here, a shoulder of the central screw 13 bears against that side face of the output element 16 which faces away from the camshaft 6, 7**.

In each case one of the side covers 17, 18 is arranged on one of the axial side faces of the drive element 14 and is fixed firmly on the latter so as to rotate with it. For this purpose, an axial opening 26 is provided in each projection 22. Furthermore, in each case five openings are provided in the side covers 17, 18, which openings are arranged in such a way that they are aligned with the axial openings 26. In each ease one screw 27 reaches through an opening of the second side cover 18, an axial opening 26 and an opening of the first side cover 17. Here, a threaded section of the screw 27 engages into a threaded section which is formed in the opening of the first side cover 17.

A pressure space 28 is formed within the device 11 between in each case two projections 22 which are adjacent in the circumferential direction. Each of the pressure spaces 28 is delimited in the circumferential direction by substantially radially extending bounding walls 29, which lie opposite one another, of adjacent projections 22, in the axial direction by the side covers 17, 18, radially to the inside by the hub element 19 and radially to the outside by the circumferential wall 21. A vane 20 protrudes into each of the pressure spaces 28, the vanes 20 being configured in such a way that they bear both against the side covers 17, 18 and against the circumferential wall 21. Each vane 20 therefore divides the respective pressure space 28 into two pressure chambers 30, 31 which act counter to one another.

The output element 16 is arranged such that it can be rotated with respect to the drive element 14 in a defined angular range. The angular range is delimited in one rotational direction of the output element 16 by virtue of the fact that the vanes 20 come to bear against in each case one corresponding bounding wall 29 (early stop 32) of the pressure spaces 28. In an analogous manner, the angular range in the other rotational direction is delimited by virtue of the fact that the vanes 20 come to hear against the other bounding walls 29 of the pressure spaces 28, which bounding walls 29 act as late stop 33.

By loading one group of pressure chambers 30, 31 with pressure and relieving the other group of pressure, the phase relation of the drive element 14 with respect to the output element 16 (and therefore the phase relation of the camshaft 6, 7 with respect to the crankshaft 2) can be varied. The phase relation can be kept constant by loading both groups of pressure chambers 30, 31 with pressure.

In the region of a camshaft bearing 39, the camshaft 6, 7 has a plurality of openings 35, via which the pressure medium which is delivered by a pressure medium pump 48 passes into the interior of said camshaft 6, 7. A pressure medium path 36 which communicates firstly with the openings 35 and secondly with the control valve 34 is formed within the camshaft 6, 7. A control valve 34 is arranged in the interior of the central screw 13 in order to supply the phase setting device 12 with pressure medium. By means of the control valve 34, pressure medium can be guided optionally to the first or second pressure chambers 30, 31 and can be discharged from the respectively other pressure chambers 30, 31.

A pressure medium channel 37 which communicates firstly with the pressure medium path 36 and secondly with a cavity 38 of the camshaft 6, 7 of hollow configuration is provided in the interior of the central screw 13. The pressure medium channel 37 is configured as an axial hole which reaches through the threaded section of the central screw 13.

Figure 4:
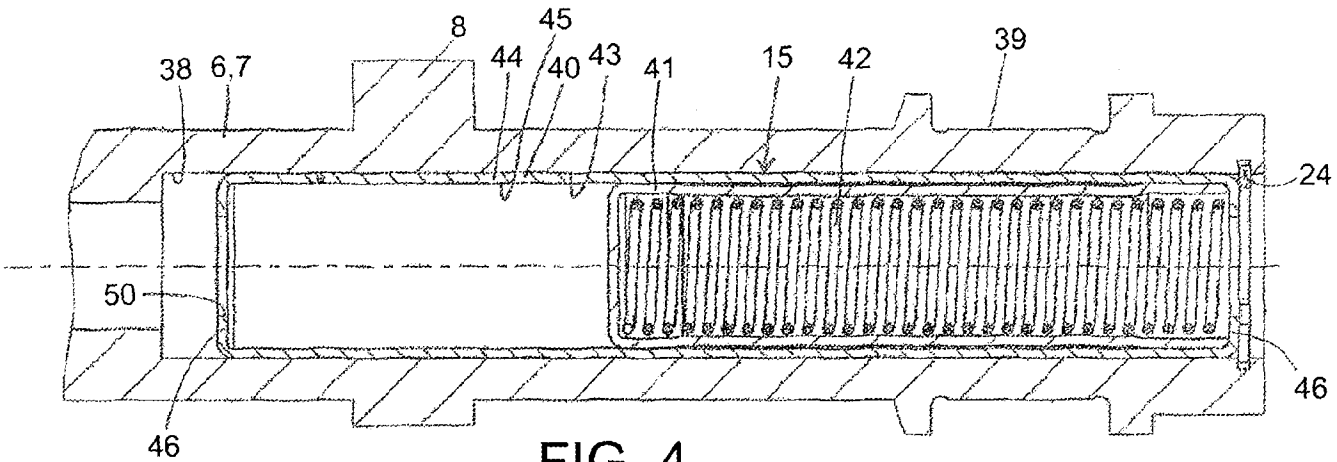
FIGS. 4, 5 show the detail X from FIG. 2.
Figure 5:
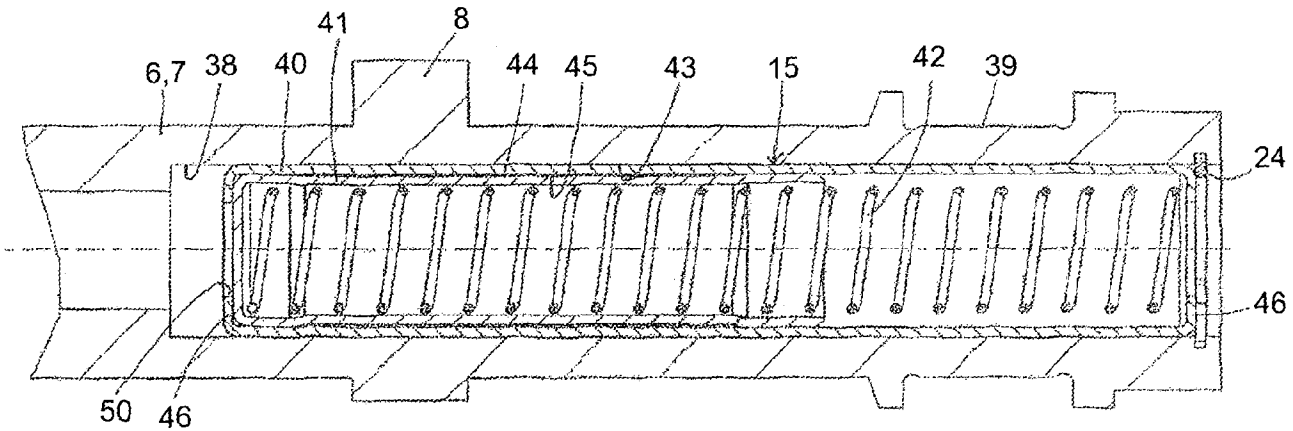

The pressure accumulator 15 is arranged in the cavity 38. FIGS. 4 and 5 show the pressure accumulator in the filled (FIG. 4) and in the emptied state (FIG. 5). The pressure accumulator 15 comprises a housing 40, a piston 41 and a force accumulator, a spring element 42 in the embodiment which is shown. The housing 40 is arranged within the cavity 38 and is connected fixedly to a wall 43 of the cavity 38. In the embodiment which is shown, the outer circumferential face of the housing 40 is adapted to the wall 43 and is connected nonpositively to the latter. Embodiments are also conceivable, in which the housing 40 is connected to the wall 43 with a material to material fit or in a positive manner. In addition, the housing 40 can be fixed by means of a securing ring 24.

The piston 41 is arranged in the interior of the housing 40 such that it can be displaced axially, said piston 41 being of cup-shaped configuration in the embodiment which is shown. The entire housing 40 serves as guide section 44, an inner circumferential face of the guide section 44 being configured as guide face 45 for a cylindrical section of the piston 41. Here, the cylindrical section of the piston 41 can bear entirely or in regions against the guide face 45. The outer circumferential face of the piston 41 is adapted to the guide face 45 in such a way that it divides the housing 40 into two regions axially in front of and behind the head of the piston 41 in a manner which is sealed with respect to pressure medium. The piston 41 is loaded with a force by means of the spring element 42 which is arranged in the region of the cylindrical section. The spring element 42 is supported on one side on a stop 46 which is formed at that end of the housing 40 which faces away from the phase setting device 12, and on the other side on the head of the piston 41. The spring element 42 therefore loads the piston 41 with a force in the direction of the pressure medium channel 37. Here, the displacement travel of the piston 41 in the direction of the pressure medium channel 37 is delimited by a stop 46 which is formed at the end which faces the phase setting device 12.

In the embodiment which is shown, the housing 40 and the piston 41 are configured as sheet metal parts which are manufactured, for example, by a chipless manufacturing method, for example a deep drawing method. This has the advantage that the guide face 45 and the cylindrical section of the piston 41 can be manufactured so precisely by this shaping process that they do not have to be machined further. Expensive further machining steps of the wall 43 of the cavity 38 are also dispensed with as a result of the use of the housing 40.

Figure 6:
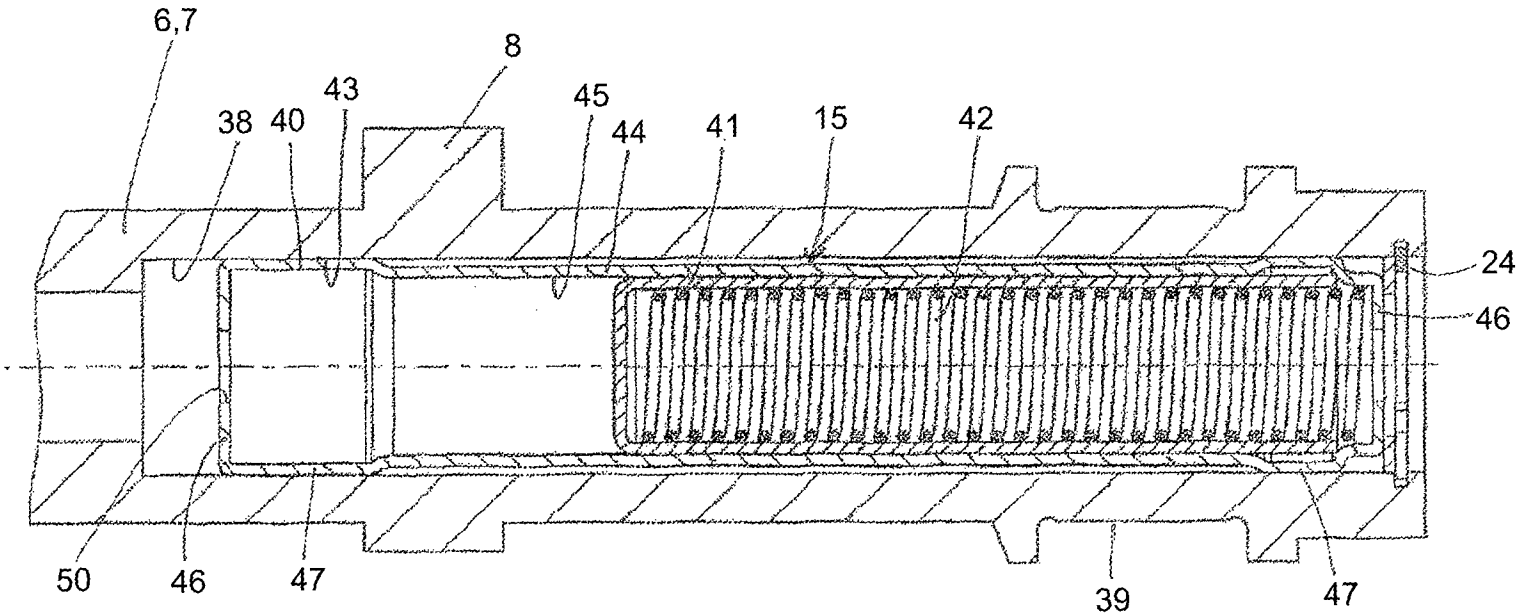
FIG. 6 shows an illustration of a further embodiment according to the invention of a device, analogously to FIG. 4.

FIG. 6 shows a second embodiment of a pressure accumulator 15. This has the difference from the first embodiment that the guide section 44 does not extend over the entire axial length of the housing 41 and does not bear against the wall 43 of the cavity 38. The guide section 44 is adjoined in the axial direction by in each case one region 47 of increased diameter. Here, the outer circumferential faces of the regions 47 of increased diameter are adapted to the wall 43. The nonpositive connection between the housing 40 and the wall 43 therefore exists only in the area of the regions 47 of increased diameter. As a result, a deformation of the guide face 45 during the operation of pressing the housing 40 into the cavity 38 is avoided.

During the operation of the internal combustion engine 1, pressure medium is guided from the pressure medium pump 48 via the openings 35, the pressure medium path 36 and the control valve 34 to the phase setting device 12. Furthermore, pressure medium is guided via the openings 35, the pressure medium path 36, the pressure medium channel 37 and a housing opening 50 into the housing 40. The pressure medium loads the piston 41 with a force, as a result of which said piston 41 is displaced axially counter to the force of the spring element 42. The pressure accumulator 15 is filled (FIG. 4). If the system pressure which is delivered by the pressure medium pump 48 drops, the force of the pressure medium on the piston 41 drops, as a result of which said piston 41 is displaced by the spring element 42 in the direction of the pressure medium channel 37 and therefore feeds pressure medium to the system. On account of a nonreturn valve 49, the pressure medium is prevented from flowing back into the pressure medium system and is therefore completely available to the phase setting device 12, as a result of which its response sensitivity and its adjusting speed are kept at a high level.

LIST OF DESIGNATIONS

1 Internal combustion engine
2 Crankshaft
3 Piston
4 Cylinder

5 Flexible drive
6 Inlet camshaft
7 Outlet camshaft
8 Cam
9 Inlet gas exchange valve
10 Outlet gas exchange valve
11 Device
12 Phase setting device
13 Central screw
14 Drive element
15 Pressure accumulator
16 Output element
**16*a*** Central opening
17 Side cover
18 Side cover
19 Huh element
20 Vane
21 Circumferential wall
22 Projection
23 Chain sprocket
24 Securing ring
25 Threaded section
26 Axial opening
27 Screw
28 Pressure space
29 Bounding wall
30 First pressure chamber
31 Second pressure chamber
32 Early stop
33 Late stop
34 Control valve
35 Openings
36 Pressure medium path
37 Pressure medium channel
38 Cavity
39 Camshaft bearing
40 Housing
41 Piston
42 Spring element
43 Wall
44 Guide section
45 Guide face
46 Stop
47 Region
48 Pressure medium pump
49 Nonreturn valve
50 Housing opening

The invention claimed is:

1. A device for variably adjusting control times of gas exchange valves of an internal combustion engine having a crankshaft, comprising:

a hydraulic phase setting device;

a camshaft; and a pressure accumulator, the phase setting device being connectable with the crankshaft by a drive connection, and said phase setting device being fixedly connected to the camshaft so as to rotate with the camshaft, a phase relation of the camshaft relative to the crankshaft being variably adjustable by the phase setting device, an interior of the camshaft having a cavity, wherein the pressure accumulator is arranged in the cavity and communicates with the phase setting device, wherein the pressure accumulator includes a housing arranged in the cavity and a longitudinally displaceable piston guided in the housing, the housing is arranged in a stationary manner in the cavity by a connection between the housing and a radially outer wall of the cavity.

2. The device as claimed in claim 1, wherein the pressure accumulator includes a spring element that loads the piston with a force counter to a force of a pressure medium.

3. The device as claimed in claim 1, wherein the housing includes at least one stop for limiting travel of the piston at least in one displacement direction of the piston.

4. The device as claimed in claim 1, wherein the housing is arranged in a stationary manner in the cavity by a nonpositive connection between the housing and the radially outer wall of the cavity.

5. The device as claimed in claim 1, wherein the housing has a guide section and the piston has an outer circumferential face that is adapted to an inner circumferential face of the guide section.

6. The device as claimed in claim 5, wherein the guide section extends over an entire length of the piston.

7. The device as claimed in claim 5, wherein the housing has a region of increased diameter at both axial ends of the guide section, outer circumferential faces of the increased diameter regions being adapted to a wail of the cavity.

8. The device as claimed in claim 1, wherein the camshaft is tubular.

* * * * *